US007607591B2

(12) United States Patent
Barch et al.

(10) Patent No.: US 7,607,591 B2
(45) Date of Patent: Oct. 27, 2009

(54) AIRBRUSH

(75) Inventors: Gary M. Barch, Simsbury, CT (US); Paul J. Corsi, Terryville, CT (US); Douglas F. Melville, Jr., Simsbury, CT (US); Charles W. Dietterich, Brodheadsville, PA (US); Luis Rodrigo Piñeiro, Bethlehem, PA (US); Robert J. Henry, Bethlehem, PA (US); Wolfgang Witz, Wake Forest, NC (US)

(73) Assignee: Hallmark Cards, Incorporated, Kansas City, MO (US)

( * ) Notice: Subject to any disclaimer, the term of this patent is extended or adjusted under 35 U.S.C. 154(b) by 241 days.

(21) Appl. No.: 11/552,496

(22) Filed: Oct. 24, 2006

(65) Prior Publication Data

US 2007/0090206 A1 Apr. 26, 2007

Related U.S. Application Data

(60) Provisional application No. 60/730,405, filed on Oct. 26, 2005.

(51) Int. Cl.
*A62C 13/62* (2006.01)

(52) U.S. Cl. ..... 239/340; 239/344; 239/346

(58) Field of Classification Search ..... 239/340, 239/302, 303, 310, 338, 344, 346, 349, 354, 239/361, 366, 373
See application file for complete search history.

(56) References Cited

U.S. PATENT DOCUMENTS

| | | | |
|---|---|---|---|
| 0,719,588 | A | 2/1903 | Hansbrouck |
| 1,172,730 | A | 2/1916 | Pettis |
| 1,326,483 | A | 12/1919 | Doran |
| 1,492,593 | A | 5/1924 | Day |
| 1,592,982 | A | 7/1926 | Loepsinger |
| 1,631,007 | A | 5/1927 | Bucknam |
| 1,840,842 | A | 1/1932 | Huff |
| 1,864,647 | A | 6/1932 | Geer |
| 1,911,367 | A | 5/1933 | Kitto |
| 1,989,696 | A | 2/1935 | Kelley |
| 2,029,141 | A | 1/1936 | Warner |
| 2,035,677 | A | 3/1936 | Steinke |
| 2,083,039 | A | 6/1937 | Searls |
| 2,149,526 | A | 3/1939 | Johnson |
| 2,213,522 | A | 9/1940 | Holmboe et al. |
| 2,368,536 | A | 1/1945 | Gersmehl |
| 2,414,375 | A | 1/1947 | Hagen |
| 2,635,921 | A | 4/1953 | Deutsch |
| 2,761,734 | A | 9/1956 | Farmer |

(Continued)

FOREIGN PATENT DOCUMENTS

| | | |
|---|---|---|
| CA | 1044195 | 12/1978 |

(Continued)

*Primary Examiner*—Davis Hwu
(74) *Attorney, Agent, or Firm*—Shook, Hardy & Bacon L.L.P.

(57) ABSTRACT

An airbrush apparatus for use in generating a design on a desired object is disclosed. The apparatus and method of use are disclosed wherein the airbrush apparatus comprises a housing, boom, and sprayer head. A fluid to be applied is contained in individual cartridges and is drawn out by a vacuum effect caused by air that is being pumped from the housing across a feed tube which is in fluid communication with the cartridge.

22 Claims, 5 Drawing Sheets

U.S. PATENT DOCUMENTS 2,785,923 A 3/1957 Hickman
2,808,294 A 10/1957 Tamminga
2,909,329 A 10/1959 Marasco
2,953,071 A 9/1960 Heywood
3,004,719 A 10/1961 Pouppirt, Jr.
3,014,661 A 12/1961 Anderson
3,026,049 A 3/1962 Leader
3,085,752 A 4/1963 Drell
3,107,058 A 10/1963 Corbett
3,379,373 A 4/1968 Roberts
3,402,008 A 9/1968 Green
3,454,228 A 7/1969 Mossop
3,515,354 A 6/1970 Presson
3,554,450 A 1/1971 D'Muhala
3,580,249 A * 5/1971 Takaoka ..... 128/200.14
3,591,088 A 7/1971 Green
3,658,091 A * 4/1972 Buzzi ..... 137/889
3,690,563 A 9/1972 Farrington et al.
3,876,150 A 4/1975 Dwyer, Jr. et al.
3,905,554 A 9/1975 Bell
3,917,168 A 11/1975 Tenney
4,023,524 A 5/1977 Goldfarb et al.
4,033,511 A * 7/1977 Chamberlin ..... 239/346
4,079,893 A 3/1978 Bass
4,206,160 A 6/1980 Suddendorf et al.
4,228,958 A 10/1980 Perry
4,261,518 A 4/1981 Russell
4,347,982 A 9/1982 Wright
4,413,784 A 11/1983 Dea
4,460,018 A 7/1984 Sweeney
4,507,074 A 3/1985 Babington et al.
4,508,271 A 4/1985 Gress
4,510,874 A 4/1985 Hasenack
4,606,501 A 8/1986 Bate et al.
4,702,415 A 10/1987 Hughes
4,795,096 A 1/1989 Smith
4,798,190 A 1/1989 Vaznaian et al.
5,131,598 A 7/1992 Hoogeveen, Jr.
5,156,684 A 10/1992 Mayer et al.
5,190,220 A 3/1993 Bolton
5,232,164 A 8/1993 Resch et al.
5,248,096 A 9/1993 Hoey et al.
5,255,852 A 10/1993 Morrison
5,297,734 A 3/1994 Toda
5,322,220 A 6/1994 Rehkemper
5,558,277 A 9/1996 Owen et al.
5,607,108 A 3/1997 Garlick et al.
5,687,886 A 11/1997 Bolton
5,716,007 A 2/1998 Nottingham
5,722,950 A 3/1998 Fujita et al.
5,868,322 A 2/1999 Loucks, Jr. et al.
5,884,846 A 3/1999 Tan
6,003,787 A * 12/1999 Fisher ..... 239/373
6,024,300 A 2/2000 Bolton
6,062,493 A 5/2000 Abplanalp
6,179,217 B1 1/2001 Yoshida et al.
6,270,021 B1 8/2001 Bolton
6,283,388 B1 9/2001 Bolton
6,293,474 B1 9/2001 Helf et al.
6,341,732 B1 1/2002 Martin et al.
6,341,736 B1 1/2002 Liao
6,431,466 B1 8/2002 Kitajima
6,616,069 B1 * 9/2003 Jou ..... 239/525
6,626,380 B1 9/2003 Williams et al.
6,892,960 B2 5/2005 Ptak et al.
6,997,396 B2 2/2006 Fedorov
2004/0069869 A1 4/2004 Ptak et al.
2004/0239736 A1 12/2004 Miyazawa et al.
2005/0145724 A1 7/2005 Blette et al.
2005/0189435 A1 9/2005 Kubota et al.

FOREIGN PATENT DOCUMENTS

CA 2048918 8/1991
CA 2162699 5/1994
CA 2226930 3/1996
CA 2259988 1/1998
CA 2322818 5/1999
CA 2044712 5/2001
CA 2392875 7/2001
CA 2500085 4/2004

* cited by examiner

AIRBRUSH

CROSS REFERENCE TO RELATED APPLICATIONS

This application claims the benefit of U.S. Provisional Application No. 60/730,405, filed on Oct. 26, 2005, having the same title and inventors.

STATEMENT REGARDING FEDERALLY SPONSORED RESEARCH OR DEVELOPMENT

Not Applicable.

TECHNICAL FIELD

This invention relates to an airbrush type device, more particularly to a device that easily permits a user to spray liquids onto an object.

BACKGROUND

Airbrushing is a long-established form of applying a liquid to a desired surface that utilizes compressed air to atomize the liquid, such as a paint or lacquer, in an air stream before applying it to the desired surface. This technique has been used in various forms, including, for example, large and small-scale art work, for the application of paint on various types of clothing and for the application of lacquer on woodworking surfaces. However, the equipment necessary to create an airbrush design can be costly and complex to a novice artisan. The compressed air necessary to atomize the paint or lacquer for larger scale projects is typically supplied by an air compressor. While an air compressor can provide an almost unlimited supply of air, a compressor can be a costly option. In addition, a compressor and related airbrush apparatus may not be portable or easily transportable between locations. This can be overly burdensome depending on the user. Further, the paints and lacquers discussed above which are typically sprayed in the airbrushes are high viscosity fluids which, in many cases, need to be diluted to a lower viscosity to improve sprayability. This is a messy operation and introduces a variable in the overall process in the amount of color atomized per unit time.

For smaller scale airbrush applications, aerosol cans have been utilized to provide finite amounts of compressed air. However, depending on the size of the aerosol can, the amount of compressed air may not be sufficient to complete a desired task, thereby requiring frequent replacement. Furthermore, it is well known that certain aerosol products may contain inherent health risks and environmental concerns including the emission of fluorocarbons. Typical airbrushes also generally have a small feed chamber that must be filled with the fluid that is to be fed into the air stream and sprayed. This process is also a messy operation that requires cleaning of the parts involved.

A feature common to most airbrush devices is the mechanism by which the paint or lacquer is supplied to the nozzle of the airbrush for atomization by the compressed air. Typically, the fluid is drawn from a supply reservoir, such as a paint can, especially for larger projects. Utilizing this type of arrangement requires that the airbrush components, such as the sprayer head and supply tubes, be cleaned out before using other colors or fluids. This can be a tedious and time-consuming task to the user. If the user wants to airbrush multiple colors, yet does not wish to spend the time cleaning the airbrush components in between colors, components of the airbrush can be replaced with clean parts, such that a user can proceed with his/her project with minimal interruption. However, there is additional cost incurred with obtaining additional spare hardware for the airbrush apparatus.

When an airbrush is in operation, the atomized liquid is applied to a desired surface or object by the user. Most airbrushes are handheld devices that are free to spray in any direction and onto any surface or object as directed by the user. While this can be a benefit to a user for airbrushing large objects or surfaces, it can also pose a safety risk to inexperienced users and bystanders such that the user could accidentally spray atomized paint onto a surface or object other than the desired location. This includes accidental spraying of another person or himself/herself, potentially causing injury. Also, these types of airbrush devices are often more suitable for older users and not younger, novice users, such as children.

BRIEF SUMMARY OF THE INVENTION

The present invention is a device that permits a user to spray a liquid on an intended object to create a design. More particularly, the present invention is an apparatus providing an airbrush type device that permits a user to spray liquid of various colors onto an object, such as a piece of paper, to create a design.

The airbrush apparatus includes a housing having an air pump at least partially contained therein. The housing preferably includes a power source coupled to the pump and a plurality of recessed portions in the outer surface thereof for receiving and storing various liquid cartridges for use with the airbrush apparatus. A boom extends from the housing and is rotatably coupled thereto. The boom is generally tubular in nature and provides a passageway for air from the pump to pass therethrough. A sprayer head is coupled to a distal end of the boom and includes a handle for grasping during operation of the apparatus and a switch for activating the pump and power source. The sprayer head includes a cartridge holder for receiving one of the cartridges containing the fluid to be sprayed. The sprayer head also includes a feed tube which cooperates with a valve in the cartridge to permit the fluid therein to pass through the feed tube during operation. An air nozzle is located within the sprayer head and directs the flow of air from the boom across the end of the feed tube. The flow of compressed air across the end of the feed tube creates a vacuum effect, which draws the fluid out of the cartridge, into the air stream, where the fluid droplets are atomized before being sprayed onto the desired object or surface. The sprayer head pivots to provide substantial freedom for spraying a desired object or surface, yet does not pivot so as to expose the user to direct contact from fluids spraying from the airbrush apparatus.

BRIEF DESCRIPTION OF THE SEVERAL VIEWS OF THE DRAWING

The features of the invention noted above are explained in more detail with a reference to the embodiment illustrated in the attached drawing figures, in which like reference numerals denote like elements, in which FIGS. 1-6 illustrate an embodiment of the present invention, and in which:

FIG. 1 is a perspective view of an airbrush apparatus in accordance with an embodiment of the present invention;

FIG. 2 is an top plan view of the apparatus of FIG. 1 with a portion of the upper housing removed to show the housing interior;

FIG. 3 is a perspective view of the apparatus of FIG. 1 with the boom in a use position;

FIG. 4 is a fragmentary perspective view of the sprayer head portion of an airbrush apparatus of FIG. 1;

FIG. 5 is a cross-sectional view of the sprayer head of FIG. 4 partially receiving a cartridge and illustrating a valve closed position;

FIG. 6 is a cross-sectional view of the sprayer head of FIG. 4 with a cartridge fully received and illustrating a valve open position;

DETAILED DESCRIPTION

Figure 1:
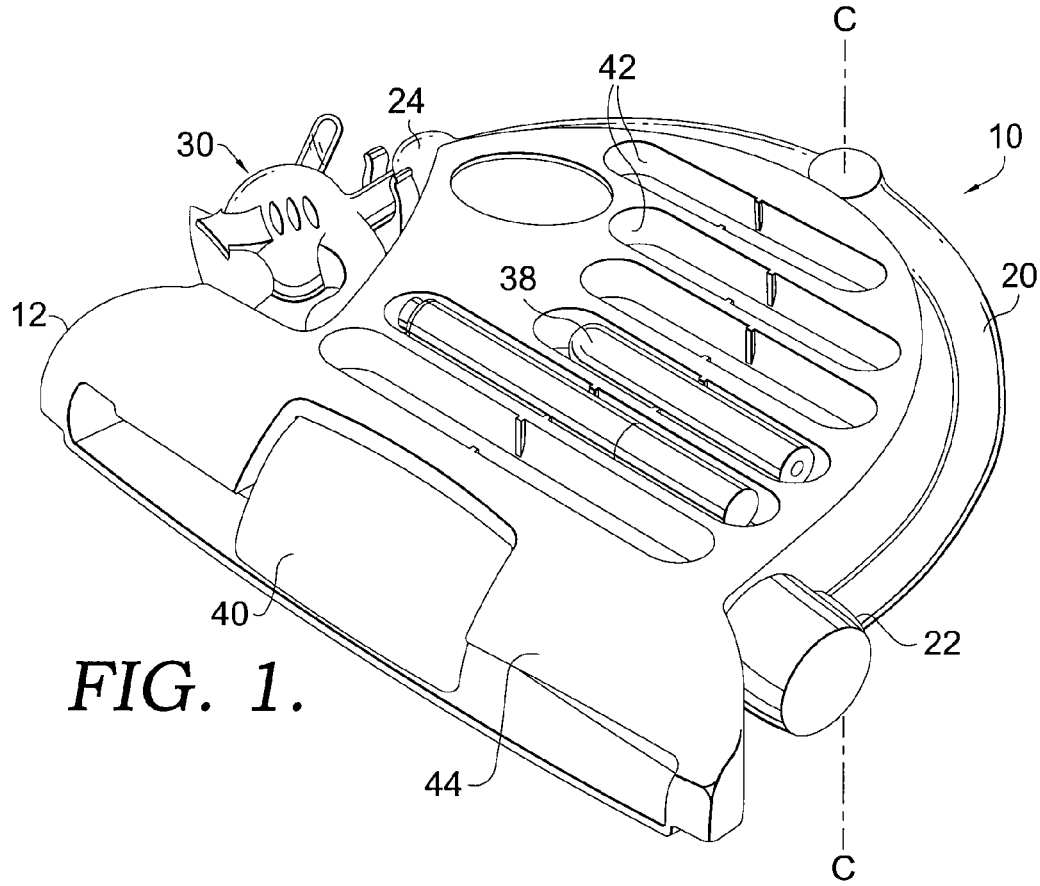
Figure 2:
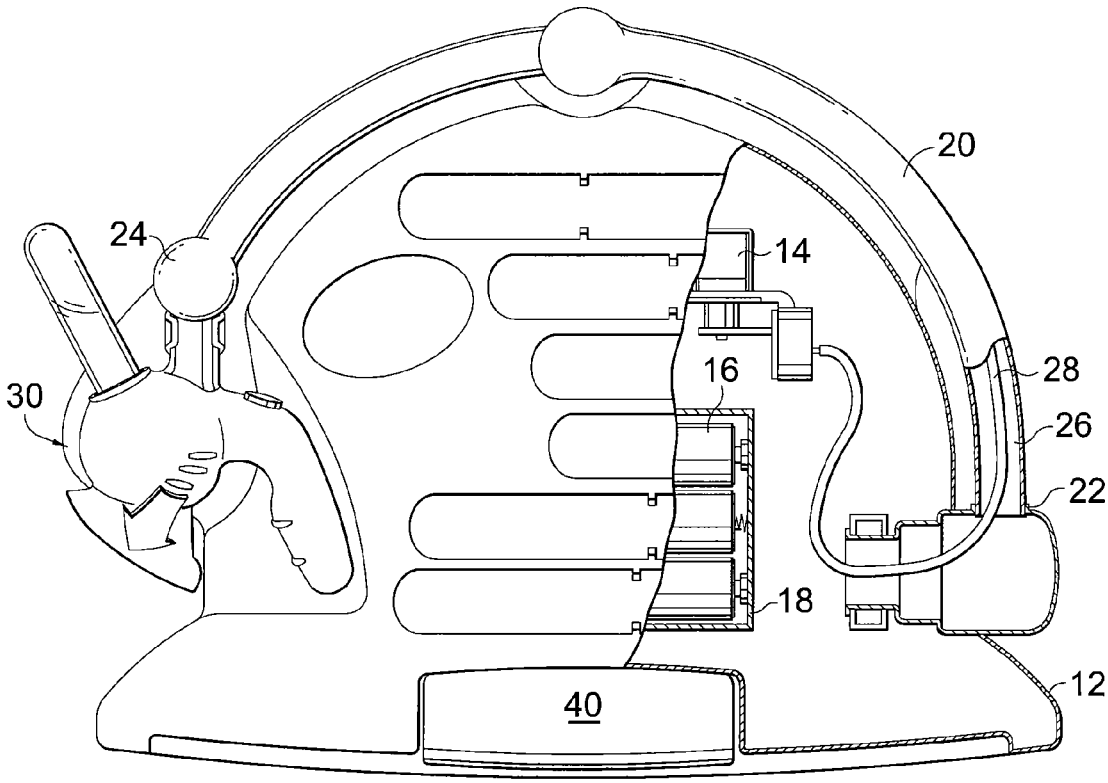

Referring now to the drawings in more detail and initially to FIGS. 1 and 2, numeral 10 generally designates an airbrush apparatus in accordance with an embodiment of the present invention. The airbrush apparatus 10 includes a housing 12 having a pump 14 at least partially contained therein. The pump 14 is powered by a power source 16, such as a plurality of batteries, that are located in a compartment 18 of the housing 12. These features are best visible in FIG. 2, which shows a partial cutaway of the housing 12.

Rotatably coupled with the housing 12 is a boom 20 that is also in fluid communication with the pump 14. The boom 20 is rotatably coupled to the housing 12 at a proximal end 22 adjacent the housing 12. The boom 20, which is generally tubular in nature, further comprises a distal end 24, located opposite of the proximal end 22, and a passage 26 which has a tube 28 extending therethrough. It is through the passage 26 and the tube 28 that the boom 20 is in fluid communication with the pump 14 (see FIG. 2). Compressed air from the pump 14 passes through the tube 28 to a sprayer head 30, which is coupled to the distal end 24 of the boom 20. Other features of the sprayer head 30 include a feed tube 32, an air nozzle 34, a diffuser 36, as well as a cartridge 38 that is removably coupled with the sprayer head 30. These features will be discussed below with respect to FIGS. 5 and 6.

The housing 12 further comprises a clip 40 for securing an object, such as a piece of paper, onto which the atomized fluids from the airbrush apparatus 10 are directed. In addition, the housing 12 includes a plurality of flutes 42 for holding at least one of the cartridges 38 when the cartridge is not being used in the sprayer head 30. The flutes 42 are located in an upper surface 44 of the housing 12.

Figure 3:
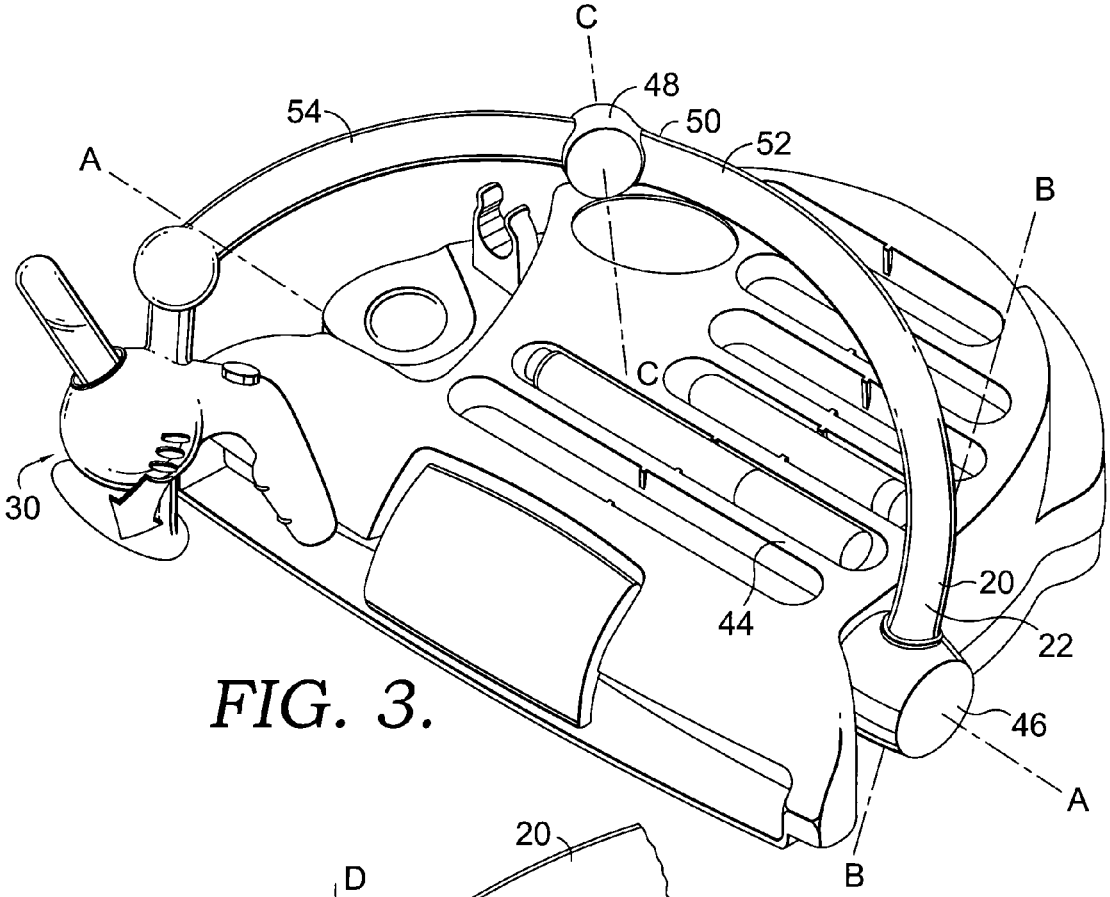

Referring now to FIG. 3, additional features of the boom 20 are shown. The boom 20 preferably has a first joint 46 and a second joint 48. The first joint 46 is located proximate the proximal end 22 of the boom 20 and the second joint 48 located approximately at a mid-point 50 of the boom 20. The first joint 46 provides a first rotatable connection between the boom 20 and the housing 12, such that the boom 20 can be moved from its collapsed storage position in FIGS. 1 and 2, to an extended, raised, or use position as shown in FIG. 3. At the first joint 46, the boom 20 may rotate about a first axis A-A, that is generally parallel to the upper surface 44 of the housing 12, and about a second axis B-B, that is generally perpendicular to first axis A-A.

The second joint 48 essentially splits the boom 20 into two sections, namely, a first section 52 and a second section 54. The second section 54 pivots relative to the first section 52 by way of a third axis C-C, which is essentially perpendicular to the upper surface 44 of the housing 12, when the boom 20 is collapsed in the housing 12, as shown in FIGS. 1 and 2. When the boom 20 is in use, the pivot capability provided by the second joint 48 allows the operator to further raise or lower the sprayer head 30, as well as move the sprayer head toward and away from the clip 40.

Figure 4:
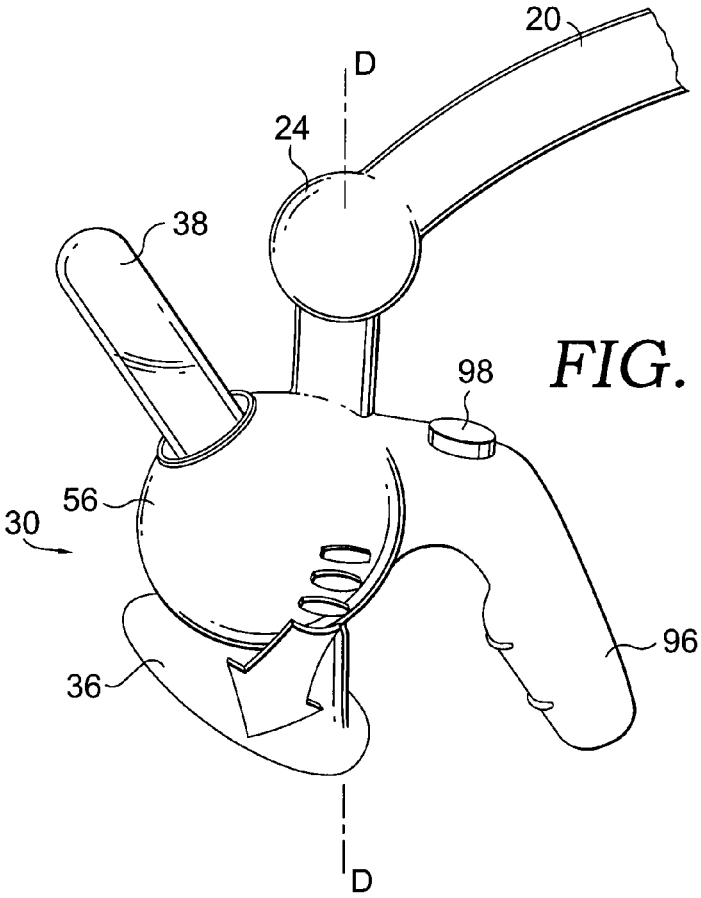
Figure 5:
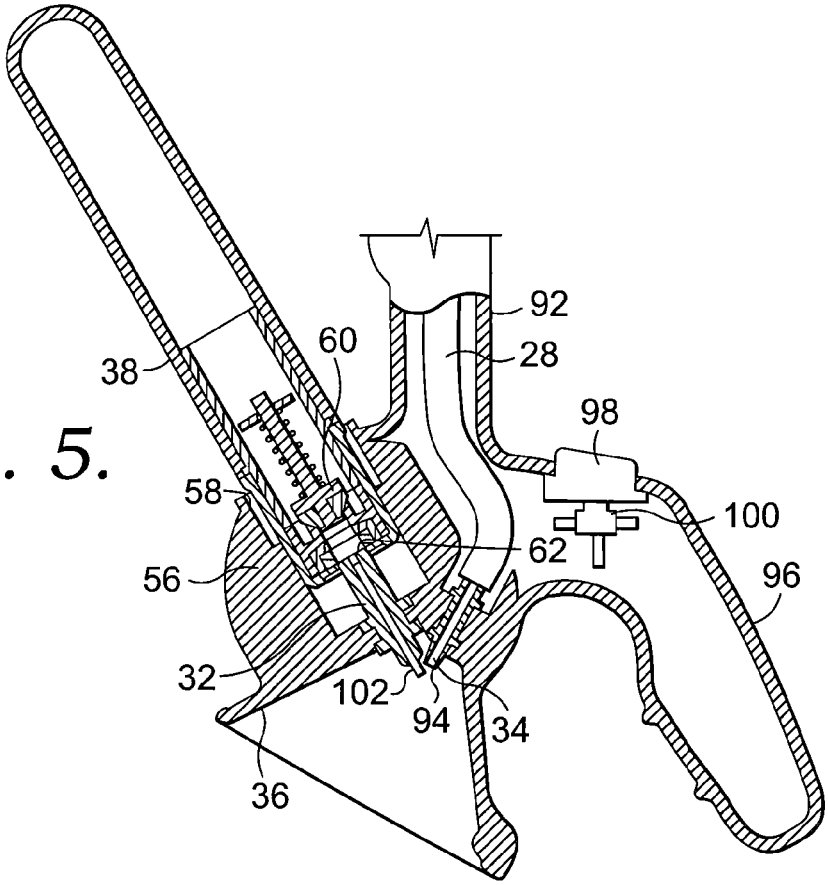
Figure 6:
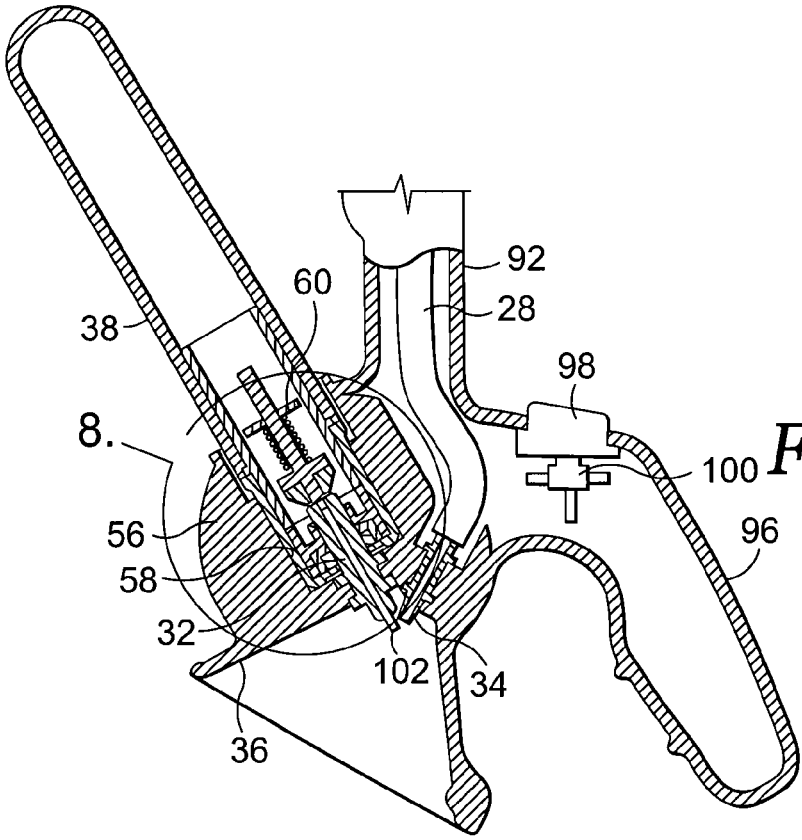

The final major component of the airbrush 10 is the sprayer head 30, which is shown in detail in FIGS. 4-6. As previously mentioned, the sprayer head 30 is coupled to the distal end 24 of the boom 20. As with other joints, the sprayer head 30 can rotate approximately 180 degrees about a fourth axis D-D proximate the distal end 24 of the boom 20. The sprayer head 30 has a feed tube 32 that is located within a cartridge holder 56.

Figure 7:
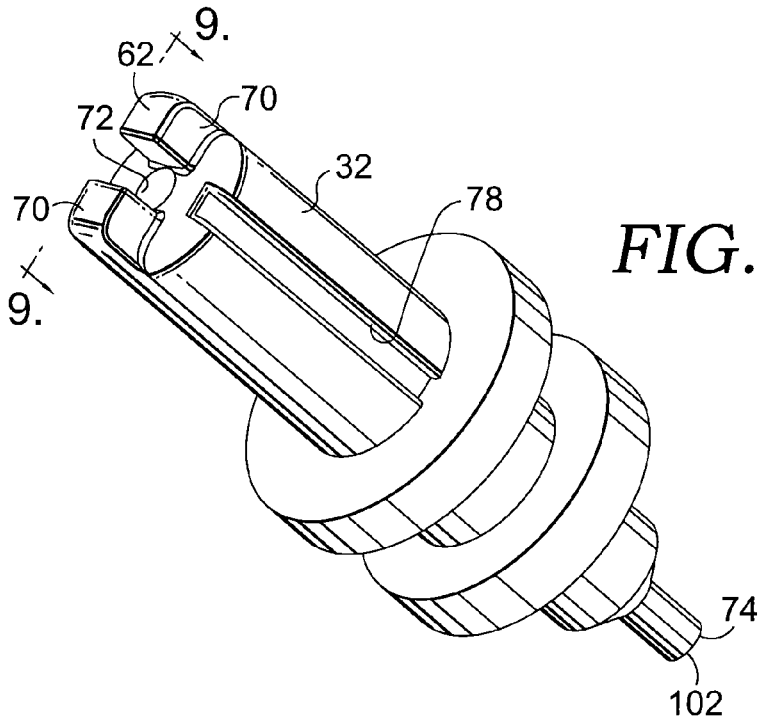
FIG. 7 is a perspective view of the feed tube of the present invention.

Referring now to FIG. 5, the cartridge holder 56 has an opening 58 for receiving the cartridge 38 that has a valve 60 and a fluid therein. The valve 60 is operable to slide between a closed position (see FIG. 5 where the bottom of the valve 60 has not yet come in contact with an upper end 62 of the feed tube 32) and an open position (see FIG. 6) upon engagement with the feed tube 32. As best illustrated in FIG. 7, the upper end 62 of the feed tube 32 preferably includes a pair of extensions 70. The extensions 70 have a space therebetween to permit the fluid to flow around and between the extensions 70. The feed tube 32 includes a passage 72 therethrough along its longitudinal axis. The passage 72 is what the fluid in the cartridge 38 passes through to exit the cartridge 38, whereby it is atomized upon exiting a lower end 74 of the feed tube 32.

Figure 9:
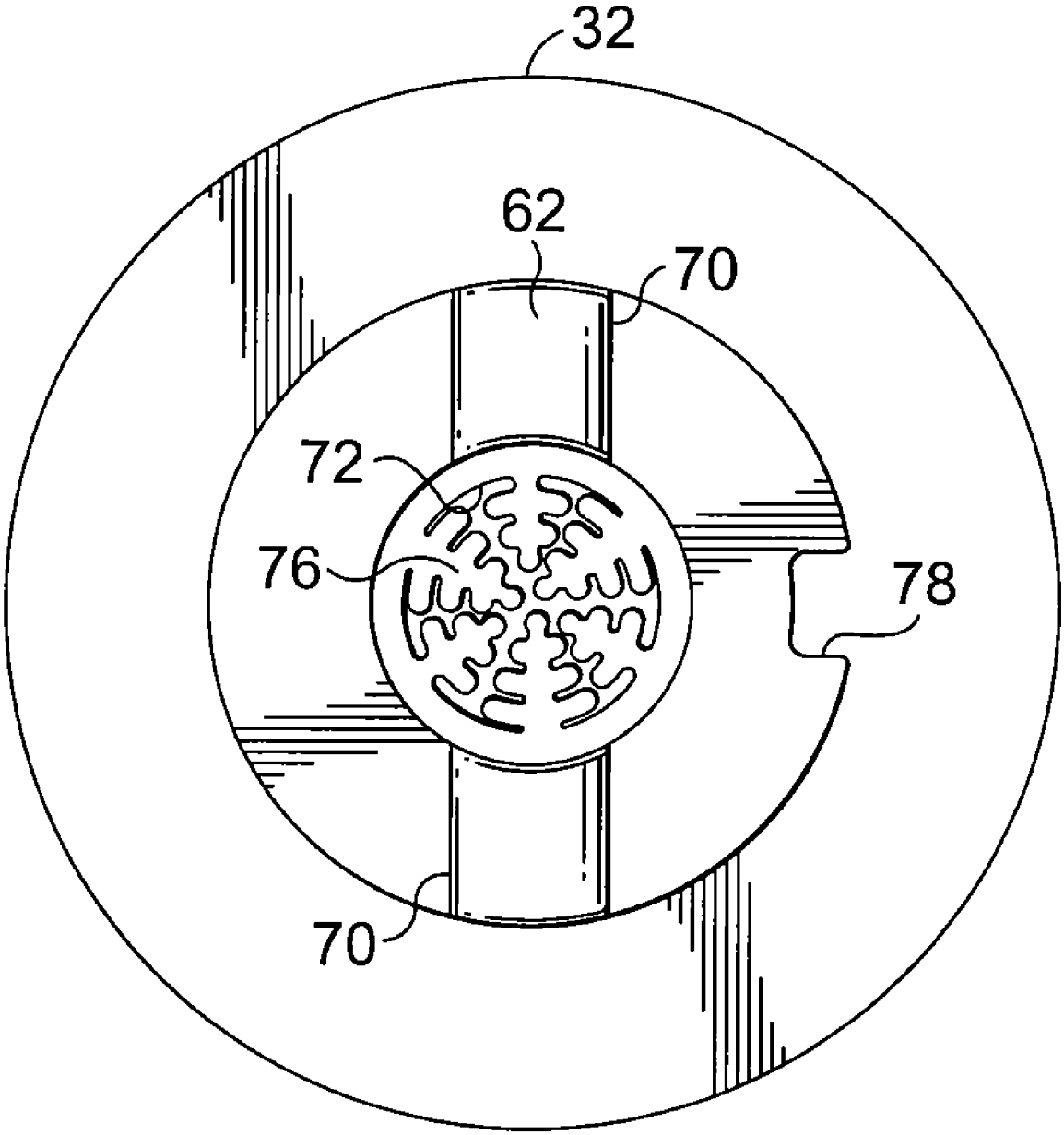
FIG. 9 is a top plan view of an embodiment of the feed tube of FIG. 7 taken in the direction of line 9-9.

The passage 72 through the feed tube 32 is preferably not simply a cylindrical bore. As best illustrated in FIG. 9, the passage 72 preferably includes a plurality of fingers 76 which extend preferably radially inward toward the center of the passage. The size, shape and space in between the fingers 76 in the passage 72 of the feed tube 32 determine the capillarity of the feed tube 32. In other words, the fingers 76 reduce the free flow of fluid through the feed tube 32 and increase the impedance. If the passage 72 was simply a cylindrical bore through the feed tube 32, when the cartridge 38 is fully received in the cartridge holder 56, the fluid would freely flow out of the cartridge through the passage 72 and drip or spill out the lower end 74 of the feed tube when the device is not in use. To prevent the fluid from leaking out of the feed tube 32 when not in use, the diameter of the cylindrical bore would need to be reduced to a dimension that would restrict the flow of the fluid through the passage 72. This dimension, while somewhat dependant on the viscosity of the fluid contained in the cartridge 38, would need to be so small to stop the free flow of fluid that it would severely reduce the amount of fluid that could pass therethrough to an unacceptably low level. Accordingly, the fingers 76 provide a large amount of surface area to restrict the free flow of the fluid through the passage 72 (i.e., they increase the capillarity of the passage 72) while at the same time provide the ability to increase the overall amount of free area through which the fluid may flow (i.e., they allow for a reduced impedance) to increase the amount of fluid that is available for atomization during use. The particular size, shape and arrangement of the fingers 76 illustrated in FIG. 9 is one of a myriad of arrangements that could be used.

The feed tube 32 also preferably includes a channel 78 in its outer surface. The channel 78 acts as an air inlet passage to permit replacement air to be drawn from outside the cartridge 38 up into the cartridge 38 during use of the air brush 10 to replace the fluid that is drawn out of the cartridge 38 during use. The use of the channel 78 as an air inlet passage will be discussed in greater detail below.

Figure 8:
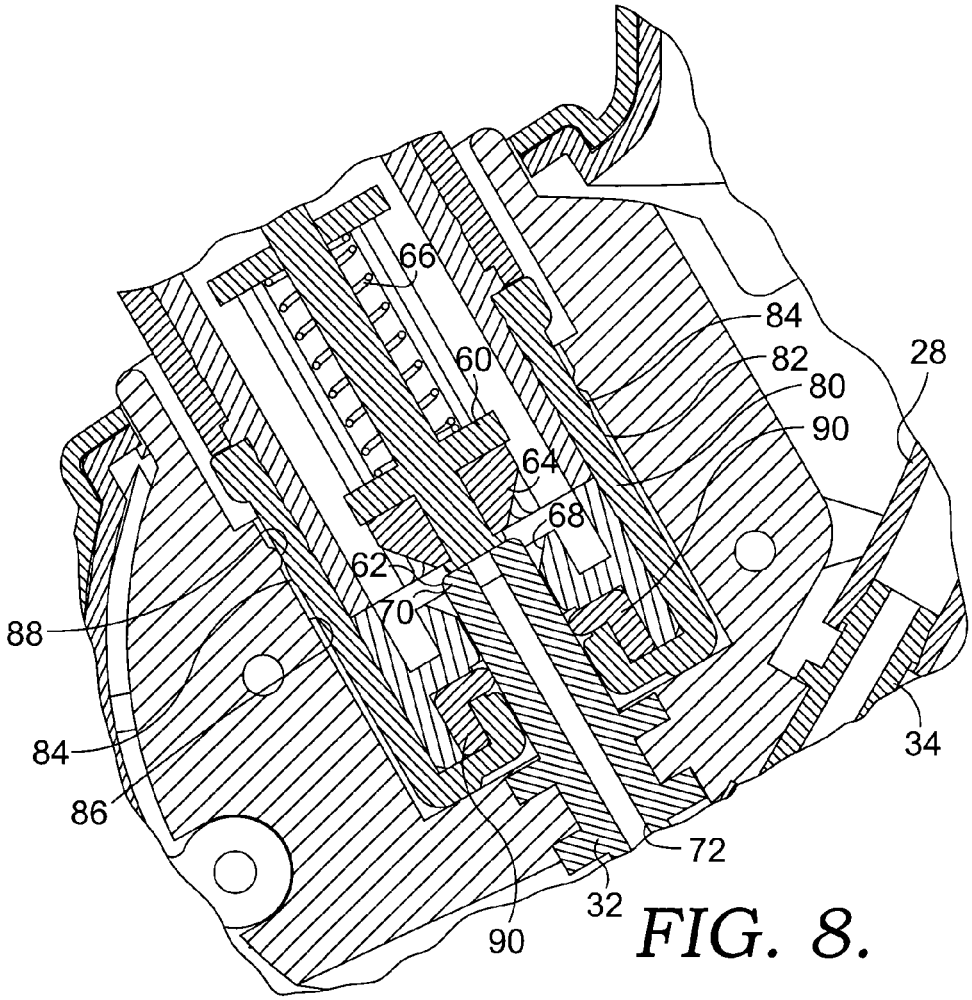
FIG. 8 is an enlarged cross-sectional view of the area identified by numeral 8 in FIG. 6.

The valve 60 is recessed up inside the cartridge 38 in an effort to decrease the possibility of accidental opening of the valve 60 when the cartridge 38 is not fully received in the cartridge holder 56. Additionally, the recessed nature of the valve 60 decreases the possibility that the valve can be opened by a child when the cartridge is not received in the cartridge holder 56. The valve 60 includes a plunger 64 that is biased by a spring 66 towards a seat 68. When the cartridge 38 is not fully received in the cartridge holder 56, as illustrated in FIG. 5, the plunger 64 is fully received in the seat 68 to prevent the fluid inside the cartridge 38 from spilling out. As the cartridge 38 is inserted into the cartridge holder 56, the valve 60 comes in contact with the upper end 62 of the extensions 70. As the cartridge 38 is further inserted into the cartridge holder 56, the valve 60 is moved by the extensions 70 from the closed position to the open position. When the cartridge 38 is fully received in the cartridge holder 56, as illustrated in FIGS. 6 and 8, the upper end 62 of the feed tube 32 holds the plunger 64 out of engagement with the seat, thereby permitting fluid to flow into the feed tube 32.

The cartridge 38 also includes a base 80 having a circumferential outer surface 82. An annular rib 84 is positioned on the outer surface 82 of the base to assist with coupling the cartridge 38 with the cartridge holder 56. In that regard, an inner wall 86 of the lower portion of the opening 58 includes a corresponding annular ridge 88. The rib 84 and ridge 88 are sized such that the outer diameter of the rib 84 is slightly larger than the inner diameter of the ridge 88 whereby the cartridge 38 must be pressed firmly downwardly to fully seet the base 80 of the cartridge 38 into the opening 58, as illustrated in FIG. 8. When the cartridge 38 is pressed downwardly such that the rib 84 is pressed pass the ridge 88, the user will feel and audibly hear a "click" that informs them the cartridge 38 is fully seated and ready for use. Additionally, the rib 84 and the ridge 88 will cooperate to frictionally hold the cartridge 38 in the cartridge holder 56 until the user affirmatively desires removal of the cartridge 38 and pulls the cartridge 38 out of the cartridge holder 56. The cartridge 38 also includes a gasket 90 to insure a tight seal of the cartridge 38 to the feed tube 36, with the exception of the cartridge air inlet passage provided by the channel 78 in the outer surface of the upper portion of the feed tube 32.

Once valve 60 is opened, the fluid, or paint, may be drawn out of the cartridge 38 and into the passage 72 of the feed tube 32. Due to the valve arrangement, fluid viscosity, capillarity of the feed tube 32 and relative pressures in the sprayer head 30 and cartridge 38, the fluid does not flow freely from the cartridge 38 when the valve 60 is open. Instead, the fluid must be drawn from the cartridge 38 via a vacuum formed by the flow of air across the lower end 74 of the feed tube, as discussed below. Individual cartridges 38 are utilized so as to prevent leakages or spillage of paints and undesired mixing of paint colors within the airbrush apparatus. Once the cartridges 38 are empty, they can be easily disposed or refilled.

The sprayer head 30 also includes the air nozzle 34. The air nozzle 34 is in fluid communication with a source of air, which in this embodiment is supplied by the pump 14 in the housing 12. Air compressed by the pump 14 flows through the tube 28 in the boom 20 and in an inlet tube 92 of the sprayer head 30. The tube 28 passes through the inlet tube and is coupled to the air nozzle 34, as can be seen in both FIGS. 5 and 6. While the passage through the air nozzle 34 has been illustrated to be a generally cylindrical bore, the diameter of the passage in the air nozzle 34 through which the air passes is more likely to gradually get smaller as it approaches a lower end 94 of the air nozzle 34. The decreasing diameter increases the pressure and velocity of the air passing through the air nozzle 34 as it exits the air nozzle 34. In that regard, the volume and velocity of the air flowing over the lower end 74 of the feed tube 32 affects the rate of atomization of the fluid. Other items that effect the rate of atomization include the capillarity of the feed tube, the viscosity of the fluid, the impedance of the passage 72 and the pressure existing in the cartridge 38.

Located generally opposite of the inlet tube 92 is the diffuser 36 of the sprayer head 30. The diffuser 36 is shaped to allow the atomized liquid particles, or paint, to expand in a controlled nature so as to not disperse beyond the targeted spray region. The diffuser 36 is preferably integrally formed with the sprayer head 30.

Lastly, the sprayer head 30 includes a handle 96, which is also integrally formed with the sprayer head 30. A button 98 is coupled to an electrical switch 100 to permit user activation of the pump 14. Upon user activation of the switch 100, the pump 14 begins to operate and direct a flow of compressed air through the tube 28. This air then passes through the air nozzle 34 in the sprayer head 30 and across an outlet 102 of the passage 72 of the feed tube 32. When the cartridge 38 is fully inserted in the cartridge holder 56, such that the valve 60 is open, the passing of air over the outlet 102 of the feed tube 32 creates a vacuum such that the liquid, or paint, in the cartridge 38 is drawn out of the cartridge 38, into the feed tube 32 and out through the outlet 102. The liquid is then atomized by the flow of compressed air from the air nozzle 34. The atomized liquid then passes through the diffuser 36 and onto the desired surface as determined by the user.

Although the airbrush apparatus 10 can be formed from any type of material including a variety of metals and plastic, the embodiment of the present invention shown in FIGS. 1-6 is preferably formed from a heavy-duty plastic. As such, it can be easily mass-produced from traditional injection molding processes at a minimal cost. Furthermore, plastic components are very durable for a variety of users, both experienced and inexperienced.

Also disclosed in the present invention is a method of applying a fluid onto an object utilizing an airbrush apparatus. This object can be a variety of items, including paper, clothing, canvas, or any other surface appropriate to receive atomized liquids, such as paints.

In use, the operator sets the housing 12 on a flat surface and rotates the boom 20 from the storage position, as illustrated in FIG. 1, to the use position, illustrated in FIG. 3. Once the airbrush apparatus 10 and the object onto which the fluid is to be applied are provided and positioned accordingly, a cartridge 38 having a particular fluid contained therein, such as a paint of a desired color, is inserted into the opening 58 in the cartridge holder 56. As the cartridge 38 is fully inserted into the opening 58 in the cartridge holder 56 and is pressed into place, the feed tube 32 contacts the valve 60 in the cartridge 38, thereby causing the valve 60 to open, and the user physically feels and audibly hears the "click" caused by the rib 84 passing the ridge 88.

Once the cartridge 38 is installed in the cartridge holder 56 of the sprayer head 30 by a user, the pump 14 is then activated by depressing the button 98 which activates the switch 100 on the sprayer head 30. As previously discussed, activating the switch 100 on the sprayer head 30 connects the power source 16 to the pump 14 which activates the pump 14 to compress air. The compressed air is directed from the pump 14 through the boom 20, and through the air nozzle 34 in the sprayer head 30, thereby causing a vacuum which draws the fluid from the cartridge 38 through the open valve 60.

It should be noted that the cartridge 38 generally includes a negative pressure therein. During use, the negative pressure in the cartridge 38 is offset or overpowered by the more negative pressure created by the Venturi effect or vacuum present at the outlet 102 of the feed tube 32. In that regard, the fluid flows through the feed tube 32 in response to a pressure differential that exists across its length. When the cartridge 38 is inserted in the cartridge holder 56 and the feed tube 32 opens the valve 60, the fluid therein begins to flow down the passage 72 and the capillarity of the passage 72 determined by the fingers 78 draws the fluid toward the lower end 74 of the feed tube 32. As the fluid approaches the outlet 102, the negative pressure inside the cartridge 38 is transmitted by the fluid and balanced by the capillary pressure of the feed tube 32, thereby preventing leakage. When the switch 100 is activated, the air flowing across the outlet 102 of the feed tube 32 creates a negative pressure that is greater than the negative pressure presently in the cartridge 38 (via the Venturi affect) such that a large pressure gradient or change exists across the length of the feed tube 32. In response, the fluid will move toward the more negative pressure (i.e., away from the now more positive pressure inside the cartridge 38) at a rate determined by the pressure differential and the impedance of the fluid through the passage 72. The fluid exiting the feed tube 32 is then atomized in the flow of air and is replaced in the passage 72 by more fluid coming from inside the cartridge 38. The lower the impedance of the passage 72 and the greater the pressure differential across its length, the greater the amount of fluid that will be atomized.

As more and more fluid leaves the inside of the cartridge 38, the negative pressure becomes greater since the air in the cartridge 38 must expand to take up the space left by the departed fluid. As the air pressure inside the cartridge 38 decreases, it approaches a value known as the bubble pressure. This is the pressure that is required to draw more air up into the cartridge 38 via the air inlet passage created by the channel 78. The smaller the passage provided by the channel 78, the greater the negative pressure must be before replacement air will be drawn in to the cartridge 38. While the present invention discloses the use of a channel in the side of the feed tube 32 to permit replacement air to enter the cartridge 38 during use, other methods may be used. For example, a duck bill type valve or a fiber plug that forces incoming air to make small bubbles as it enters the liquid reservoir of the cartridge may be used.

As the fluid is drawn out of the feed tube 32, compressed air from the air nozzle 34 atomizes the fluid into fine particles, which are then directed through the diffuser 36 and out onto the object. Once a user is finished or wishes to change cartridges, the user releases the switch 100, which in turn, disconnects the power source 16 from and deactivates the pump 14. If the user desires to continue using the airbrush apparatus 10 with a different colored fluid, or wishes to store the airbrush apparatus 10 away for a later use, the cartridge 38 is removed and placed in one of the flutes 42. When the cartridge 38 is removed from the cartridge holder 56 and disengages from the feed tube 32, the valve 60 in the cartridge 38 returns to the closed position, as shown in FIG. 5, to prevent fluid leakage. Should the user opt to continue operating the airbrush apparatus 10, a second cartridge 38 is selected and inserted into the cartridge holder 56. The user then repeats the process described herein.

One type of fluid that may be used in the cartridges 38 is a proprietary fluid marketed under the trademark Color Wonder®. The color only becomes visible when sprayed on corresponding Color Wonder® paper. Utilizing these proprietary materials ensures that the airbrushing only occurs on a desired surface and makes such a device more user-friendly to younger, novice users. It should be noted that the present invention can be used to spray a wide variety of fluids, including fluids with a low viscosity.

Many different modifications to the invention can be made and still be within the scope of the present invention. For example, a torsion spring (not shown) may be positioned in the second joint 48 to return the second section 54 of the boom 20 to its rest position after displacement. Further, the connection between the inlet tube 92 and the distal end 24 of the boom 20 may be made to be rotatable to permit the sprayer head 30 to rotate with respect to the boom 20. The arrangement of the boom 20 disclosed herein allows the sprayer head 30 to maintain a uniform distance above the surface upon which the paper being sprayed is located during use as it is moved there across. Additionally, it is envisioned that various stencils could be used with the apparatus to permit younger users to create designs.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

The invention claimed is:

1. An airbrush apparatus comprising:

a housing;

a pump at least partially contained within the housing;

a boom rotatably coupled with the housing, the boom having a proximal end adjacent the housing and a distal end opposite the proximal end;

a sprayer head coupled with the distal end of the boom, the sprayer head having a feed tube including a passage therethrough having a plurality of fingers extending generally radially inward from a sidewall of the passage, an air nozzle, and a diffuser, wherein the air nozzle is operationally coupled with the pump; and, a cartridge removably coupleable with the sprayer head, the cartridge having a fluid therein which passes through the passage during use and out an outlet end of the feed tube.

2. The apparatus of claim 1, further comprising a power source for operating the pump.

3. The apparatus of claim 2, further comprising a switch electrically coupled with the pump and the power source, wherein activation of the switch causes operation of the pump which in turn pushes air through the air nozzle in the sprayer head.

4. The apparatus of claim 3, wherein the air passing from the air nozzle in the sprayer head is directed across an outlet end of the feed tube, thereby drawing out and atomizing the fluid from within the cartridge.

5. The apparatus of claim 1, wherein the cartridge further includes a means for allowing replacement air to enter the cartridge during use.

6. The apparatus of claim 5, wherein the means for allowing replacement air to enter the cartridge during use includes a longitudinal channel in an outer surface of the feed tube.

7. The apparatus of claim 1, formed primarily of a molded plastic, wherein the sprayer head rotates approximately 180 degrees about the distal end of the boom, wherein the housing further comprises a clip for securing an object on which the fluid is to be applied to the housing, and wherein the housing further includes a plurality of flutes therein for releasably holding at least one cartridge.

8. The apparatus of claim 1, wherein the boom has at least a first joint and a second joint, wherein the first joint is located proximate the proximal end and the second joint is located proximate a mid-span of the boom.

9. A method of applying a fluid onto an object comprising:

providing an airbrush apparatus comprising:

a housing;

a pump at least partially contained within the housing;

a boom rotatably coupled with the housing and operationally coupled with the pump, the boom having a proximal end adjacent the housing and a distal end opposite the proximal end;

a sprayer head coupled to the distal end of the boom, the sprayer head having a cartridge holder, a feed tube having a passage and a plurality of fingers extending generally radially inward from a sidewall of the passage, an air nozzle operationally coupled with the pump, and a diffuser; and, a cartridge removably coupleable with the sprayer head, the cartridge having a fluid therein and a valve;

inserting the cartridge into an opening in the cartridge holder, thereby opening the valve in the cartridge;

activating the pump by a switch;

directing air from the pump through the air nozzle in the sprayer head and across an outlet end of the feed tube, thereby causing a vacuum which draws the fluid from the cartridge through the open valve, through the feed tube, out the outlet end and into the air stream, wherein the fluid is atomized in the air stream from the air nozzle in the sprayer head; and directing the atomized fluid through the diffuser onto to the object.

10. The method of claim 9, further comprising deactivating the pump by deactivating the switch.

11. A sprayer mechanism for use with an air source for applying a fluid to an object, the mechanism comprising:

a sprayer head having an air nozzle and a diffuser, the air nozzle being in fluid communication with the air source;

a handle coupled with the sprayer head, the handle having a button for controlling activation of the air source;

a cartridge holder coupled with the sprayer head, the cartridge holder having an opening and a feed tube therein, wherein the feed tube includes a passage therethrough, whereby fluid from within the cartridge passes through the passage during use and out an outlet end of the feed tube, and wherein the passage includes a plurality of fingers extending generally radially inwardly from a sidewall of the passage; and a cartridge at least partially received in and removably coupleable with the cartridge holder; wherein the cartridge contains the fluid to be applied therein, and wherein the cartridge includes a valve for selectively releasing the fluid.

12. The mechanism of claim 11, wherein the valve of the cartridge is operable to move between a closed position and an open position upon engagement with the feed tube.

13. The mechanism of claim 11, further comprising:

a housing;

a pump at least partially contained within the housing; and a boom rotatably coupled with the housing and operationally coupled with the sprayer head, the boom having a proximal end adjacent the housing and a distal end opposite the proximal end.

14. The mechanism of claim 13, wherein the sprayer head is rotatable up to approximately 180 degrees about the distal end of the boom.

15. The mechanism of claim 13, wherein the boom has at least a first joint and a second joint, wherein the first joint is located proximate the proximal end and wherein the second joint is located proximate a mid-span of the boom.

16. The mechanism of claim 13, further comprising a power source.

17. The mechanism of claim 16, wherein the button is coupled with an electrical switch, wherein the switch is electrically coupled with the power source, and wherein activation of the switch causes the pump to push air through the air nozzle of the sprayer head.

18. The mechanism of claim 17, wherein the air pushed through the air nozzle of the sprayer head is directed across an outlet end of the feed tube, thereby creating a low pressure area at the outlet end of the feed tube which draws the fluid out of the cartridge, through the valve, through the feed tube and into the air directed across the outlet end of the feed tube where it is atomized.

19. The mechanism of claim 11 wherein the cartridge includes a replacement air mechanism for permitting outside air into the cartridge to replace the fluid drawn out of the cartridge during use.

20. The mechanism of claim 19, wherein the replacement air mechanism includes a longitudinal channel in an outer surface of the feed tube.

21. The mechanism of claim 11, wherein the opening in the cartridge holder includes an inwardly projecting rib, wherein the cartridge includes an outwardly projecting ridge on an outer surface thereof, and wherein the inwardly projecting rib and the outwardly projecting ridge cooperate to hold the cartridge in cooperation with the cartridge holder during use.

22. The mechanism of claim 11, wherein the valve of the cartridge includes a plunger that is biased into engagement with a seat when the valve is in a closed position, wherein the valve is movable out of engagement with the seat to an open position, and wherein receipt of the cartridge into the opening of the cartridge holder moves the valve from the closed position to the open position.

* * * * *

UNITED STATES PATENT AND TRADEMARK OFFICE

CERTIFICATE OF CORRECTION

PATENT NO. : 7,607,591 B2
APPLICATION NO. : 11/552496
DATED : October 27, 2009
INVENTOR(S) : Gary M. Barch et al.

It is certified that error appears in the above-identified patent and that said Letters Patent is hereby corrected as shown below:

Title Page; item (73);
The Assignee is changed from "HALLMARK CARDS INCORPORATED, Kansas City, Missouri" to "BINNEY & SMITH INC, Easton, Pennsylvania".

Signed and Sealed this

Sixteenth Day of March, 2010

David J. Kappos

David J. Kappos
*Director of the United States Patent and Trademark Office*